US005695361A

United States Patent [19]

Elisei

[11] Patent Number: 5,695,361

[45] Date of Patent: Dec. 9, 1997

[54] LOW PROFILE COMMUNICATIONS OUTLET

[75] Inventor: Davide Elisei, Auvers sur Oise, Italy

[73] Assignee: The Whitaker Corporation, Wilmington, Del.

[21] Appl. No.: 721,636

[22] Filed: Sep. 26, 1996

[30] Foreign Application Priority Data

Oct. 9, 1995 [FR] France ..... 95 11865

[51] Int. Cl.[6] ..... H01R 4/24

[52] U.S. Cl. ..... 439/535; 439/404; 439/76.1; 439/610

[58] Field of Search ..... 439/535, 76.1, 439/404, 610

[56] References Cited

U.S. PATENT DOCUMENTS

| | | | |
|---|---|---|---|
| 4,820,192 | 4/1989 | Denkmann et al. | 439/404 |
| 4,865,564 | 9/1989 | Denkmann et al. | 439/404 |
| 4,894,024 | 1/1990 | Debortoli et al. | 439/535 |
| 5,091,826 | 2/1992 | Arnett et al. | 439/404 |
| 5,356,310 | 10/1994 | Garthwaite et al. | 439/535 |
| 5,385,488 | 1/1995 | Clark | 439/535 |

FOREIGN PATENT DOCUMENTS

WO 87/07775 12/1987 WIPO .

OTHER PUBLICATIONS

British Search Report.

*Primary Examiner*—Gary F. Paumen

[57] ABSTRACT

A communications outlet comprises a face-plate and a connection assembly module. The assembly module comprises an outlet connector and a cable connector mounted on a printed circuit board (PCB). Different outlet connectors and PCBs can be provided whilst the design of the cable connector remains unchanged. The positioning of the outlet connector and cable connector directly on the PCB which is substantially parallel to the outer wall of the face-plate provides a low profile communications outlet. Stuffer members provide rapid tool-less connection of cable conductors to insulation displacement contacts of the cable connector. An advantageous feature is the provision of secondary locking extensions on the face-plate that engage behind the resilient latches of the connection assembly module for mounting of the module to a wall plate. The secondary locking extensions ensure secure retention of the connection assembly to the wall plate.

12 Claims, 5 Drawing Sheets

LOW PROFILE COMMUNICATIONS OUTLET

BACKGROUND OF THE INVENTION

1. Field of the Invention

This invention relates to a connection assembly for data communication, in particular an outlet for mounting on a panel, wall or floor, that can be rapidly connected and disconnected and has a standard mounting interface for modular exchange of the connection assembly.

2. Description of the Prior Art

Communications outlets are commonly used in local area networks for interconnection of telephone, computer and other communications devices. European Patent 274 487 describes a local area network interface having a connection assembly that has a modular construction comprising a connector module having a printed circuit board (PCB) extending orthogonally from the face of the connector module. The connector module can be plugged into an edge-card connector mounted within a wall box, such that a plurality of different modules can be interchanged very rapidly without the need to rewire the cable to the connector.

Although this allows rapid interchangability and is very advantageous from this standpoint, the orthogonal disposition of the PCB produces a communications outlet that has a reasonably large depth. In certain applications, for example in use in houses or buildings, it may be desirable to have a low profile communications outlet. It is also desirable to provide a cost-effective communications outlet whilst nevertheless ensuring high speed reliable communications, and the possibility of interchanging the module in a relatively rapid and essentially tool-less manner.

SUMMARY OF THE INVENTION

An object of this invention is to provide a communications outlet that is cost-effective and allows easy interchangability of connection modules, but nevertheless has a low profile.

It is a further object of this invention to provide a cost-effective low profile communications outlet that is easy to connect in an essentially tool-less manner to a cable, and is also reliable for high speed data transmission.

Objects of this invention have been achieved by providing a communications outlet comprising a connector module having an outlet connector mounted on a PCB, and a second connection module mounted on a PCB with connection sections for rapid tool-less connection to conductors of a cable, the module being pluggably mounted to a wall box or other structure and receiving a face-plate thereover. In an advantageous embodiment, the face-plate may comprise secondary locking members that securely lock the mounting means of the modules to the wall box or other structure. The connection sections of the connection module may be provided with shielding coverparts positioned over the connection sections for shielding the portion of exposed cable and terminals of the connection sections. The connection module may comprise an insulative frame and connector housings flanking a central area that is open, thereby allowing access for mounting of the outlet connector to the PCB. For rapid connection and disconnection of the cable to the connection sections, the connection section may be provided with insulation displacing contacts (IDCs) over which are mounted stuffer members that receive the wires and can be actuated to stuff the wires in the IDCs, respectively disconnect the wires therefrom, in a quick, reliable and tool-less manner.

The outlet may be latched to a panel or wall, and a cover provided with extensions that insert behind the latches to block them in place thereby securely locking the outlet to the panel in a tool-less manner.

Other advantageous aspect of the invention will be apparent from the claims and description.

DETAILED DESCRIPTION OF THE PREFERRED EMBODIMENT

Figure 1:
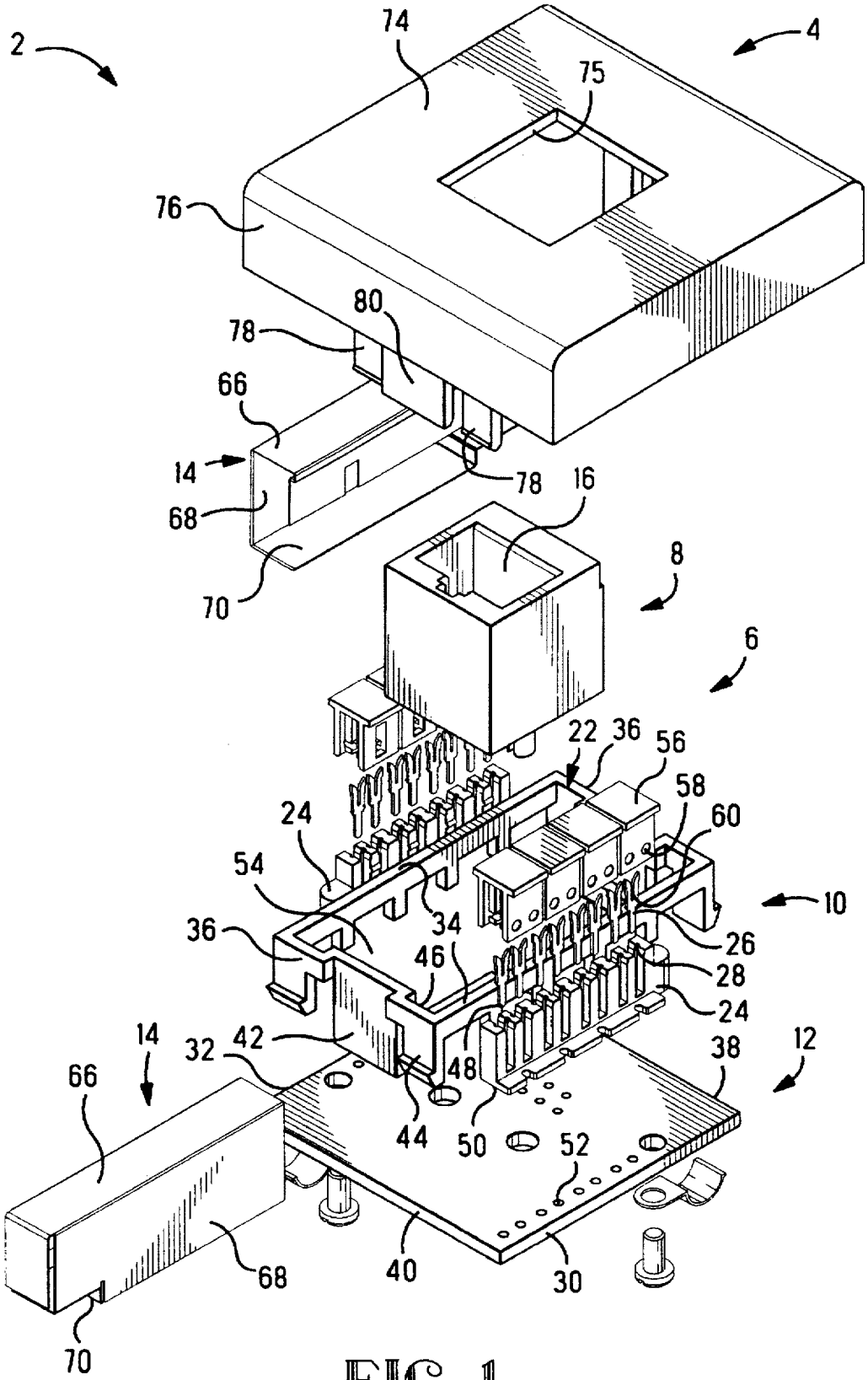
FIG. 1 is an exploded isometric view of a communications outlet according to this invention.
Figure 2:
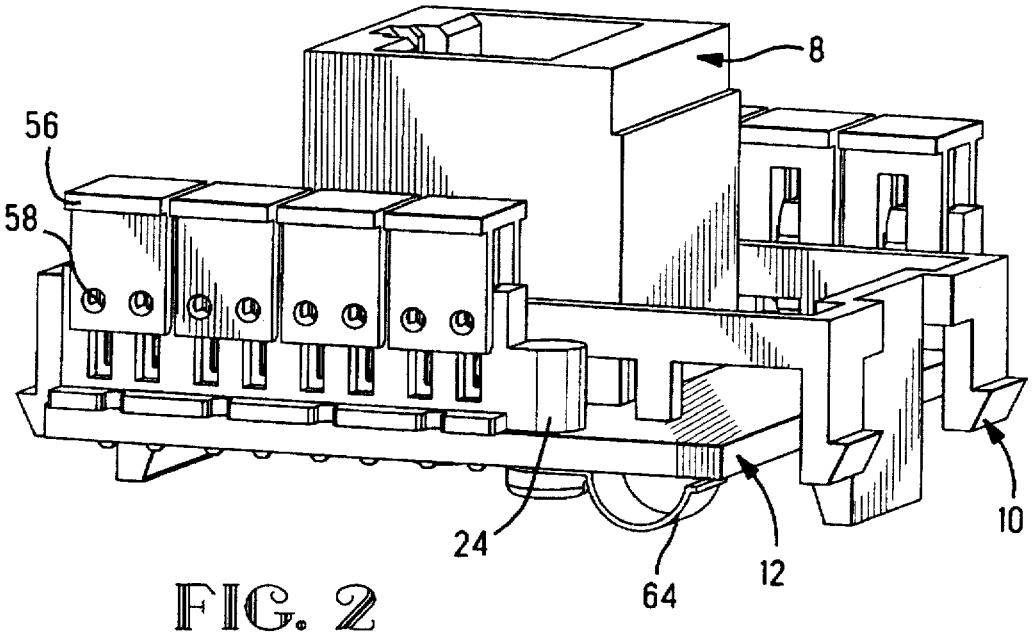
FIG. 2 is an isometric view of the communications outlet without the face-plate or shielding.

Referring to FIGS. 1–5, a communications outlet 2 comprises a face-plate 4 and a connection assembly module 6 having an outlet connector 8, a cable connector 10, both connectors mountable on a PCB 12, and shield members 14.

The outlet connector 8 is for connection to a complementary plug receivable in the cavity 16. A variety of different outlet connectors 8',8" can however be provided as shown in FIGS. 6*a*, 6*b* and 7*a*, 7*b* for mounting on the PCB 12. Different PCBs 12 can be provided for receiving the different connection configurations of the various outlet connectors 8,8',8", and furthermore various electrical and electronic components can be mounted on the PCB for filtering or otherwise treating the electrical signals transmitted between conductors 18 of a cable 20 (see FIG. 3) and the outlet connector 8. The PCB 12 is also provided with conductive circuit traces thereon that interconnect the outlet connector to the cable connector 10.

The cable connector 10 comprises an insulative frame 22 having terminal receiving housings 24, and IDC terminals 26 mountable in cavities 28 of the housing 24. A pair of housings 24 may be provided in a spaced-apart manner for positioning along opposed, substantially parallel edges 30,32 of the PCB 12. The frame 22 is unitary with the housings 24 in this embodiment, and forms a generally rectangular shape having side walls 34 adjacent the housings 24 and interconnected at their ends by end walls 36 that are mountable alongside opposed outer edges 38,40 of the PCB 12. The edges 38,40 extend between the edges 30,32. It is also conceivable to have the housings 24 separate from the frame 22. The frame 22 is provided with first mounting or latching members 42 for attachment to the PCB 12, the members 42 comprising resilient latches that clip over the edged 38,40 of the PCB 12. The frame 22 comprises further module mounting members 44 that are positioned beyond and over the edges 38,40 of the PCB 12. The mounting members 48 extend from the frame end walls 36 and are resiliently inwardly biasable towards the central area of the PCB, and serve to quickly and simply latch the connection assembly module to a frame, panel or other structure for assembly thereto.

The module mounting latches 44 are stepped away from the edges 38,40 of the PCB to provide a recess 46 behind the latches for reasons that will be described hereinafter. The IDC terminals 26 are substantially planar and edge stamped from sheet metal, the terminals being securely locked within their cavities 28 and having PCB contact pins 48 that extend below a lower surface 50 of the housings 24. The pin contact portions 48 may either be compliant pins, or soldering pins for mounting through plated through-holes 52 of the PCB. The outlet connector 8, cable connector 10, and PCB 12 can therefore be assembled together as a single unit whereby the cable connector 10 is a standard modular part and the outlet connector 8 and PCB 12 is another part that may be adapted as a function of the outlet 8,8',8" that is required, and the electronic circuitry. The frame 22 provides a standard mounting configuration for rapid assembly of the connection assembly module to a structure whilst nevertheless being produced from few parts and forming a central area 54 within which different outlet connectors 8 can be received.

The cable connector further comprises stuffer members 56 having cavities 58 for receiving wires 18 of the cable 20 therethrough, the stuffers movable from an upper position where the wires can be received in the cavities 58 to a lower position where the wires are forced into slots 60 of the IDC contacts for electrical connection thereto. The stuffer members 56 thus enable easy and rapid connection or disconnection of wire pairs (for example twisted pairs of a data cable) to the IDC contacts 26. Rapid mounting and dismounting of the connection assembly module from a structure, and rapid connection or disconnection of a cable to the cable connector 10 enables relatively easy and rapid exchange of connection assembly modules if another interface is required. The provision of the PCB 12 in a plane that is substantially parallel to an outer wall 74 of the face-plate 4, and positioning of the connector 8 between the cable connectors directly on the PCB ensures a compact and low profile communications outlet.

Figure 3:
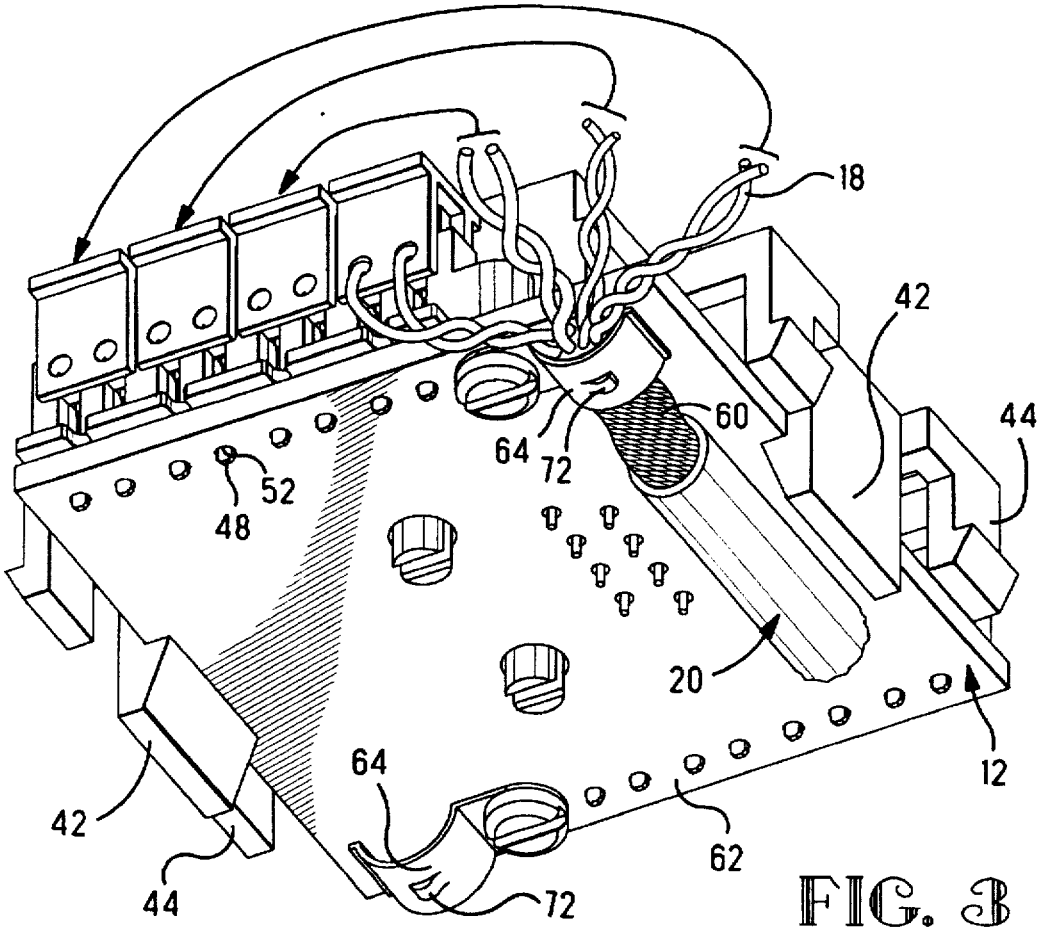
FIG. 3 is an isometric view of the bottom side of the communications outlet partially connected to a cable.
Figure 4:
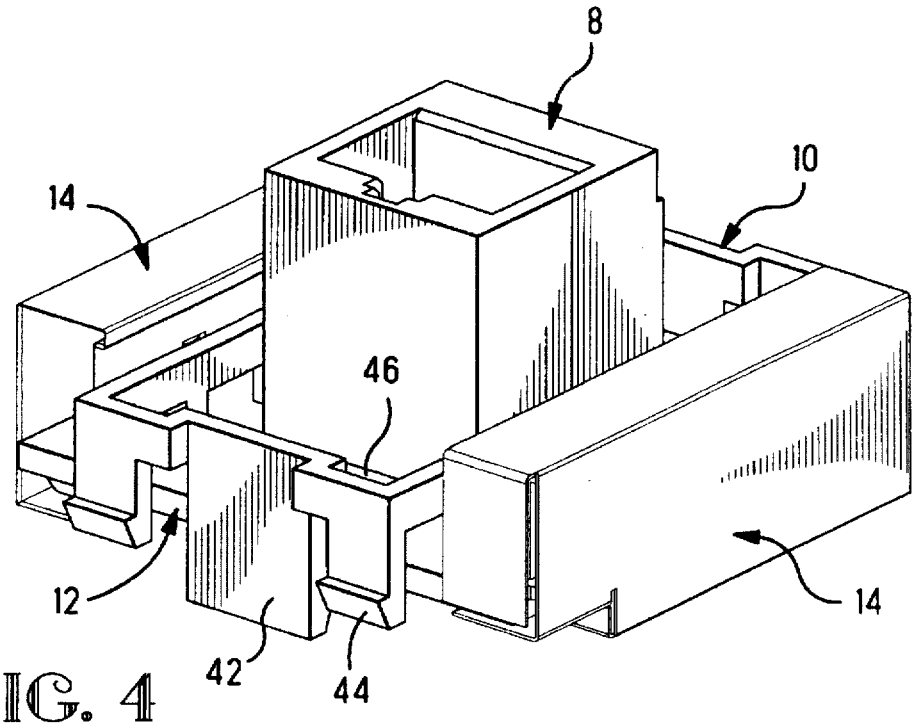
FIG. 4 is an isometric view of the communications outlet without face-plate but with shielding members mounted over the connection section.

The cable 20 (refer to FIG. 3) may comprise a plurality of twisted wire pairs and an outer shielding braid 60 surrounding the wire pairs. In the embodiment of FIG. 3, the cable is secured to a lower side 62 of the PCB 12 by a grounding clip 64 that is secured to the PCB. The shielding members 14 are identical parts received on either side of the PCB along the edges 30,32 over the cable connector housings 24 and stuffer members 56. The shield members 14 comprise a top wall 66, side wall 68 and bottom wall 70. The bottom wall 70 is received below and spaced from the lower side 62 of the PCB so as to surround the wires 18 that extend from the end of the cable. The bottom wall 70 resiliently biases over the grounding clip 64 which may be provided with a resilient protrusion 72 for ground connection to the shielding member 14. To enable positioning of two cables compactly below the PCB 12, a pair of grounding clips 64 are at diametrically opposed corners of the PCB, whereby the shielding members 14 are slid thereover from opposing sides of the PCB as indicated by their disposition shown in FIG. 1. The shielding members 14 thus shield the exposed conductors 18 and terminals 26 for reduction of electromagnetic noise generation and reception, in particular for high speed signal transmission.

Figure 5:
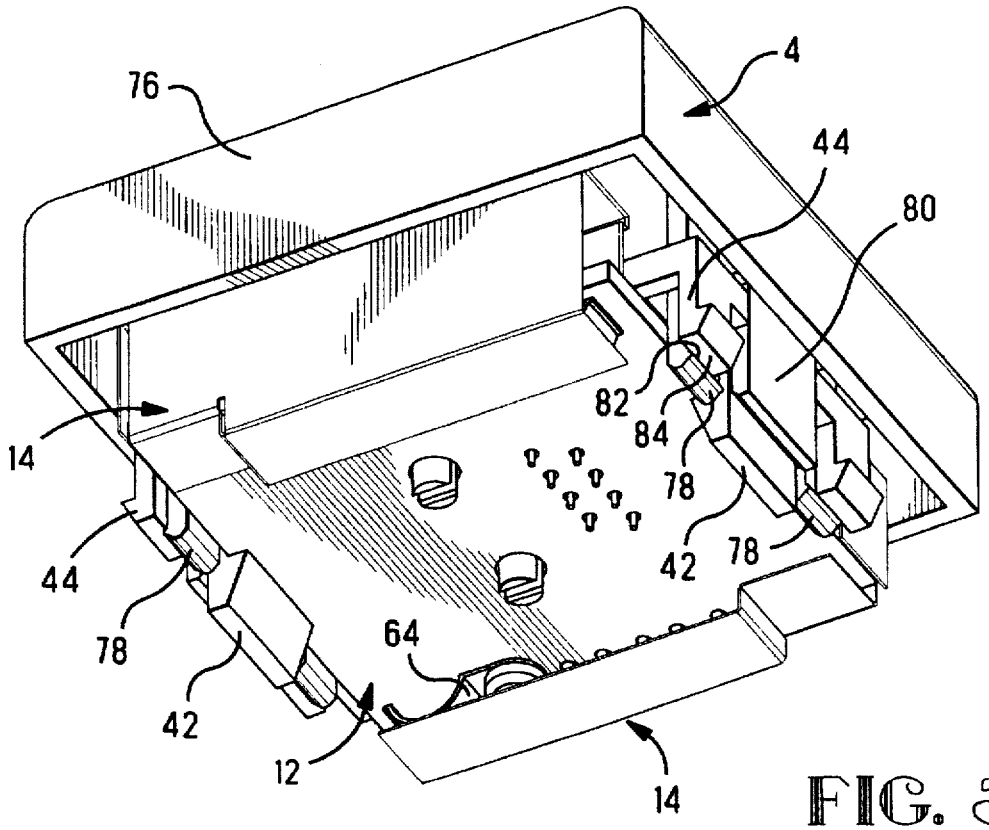
FIG. 5 is a bottom isometric view of the communications outlet.
Figure 6A:
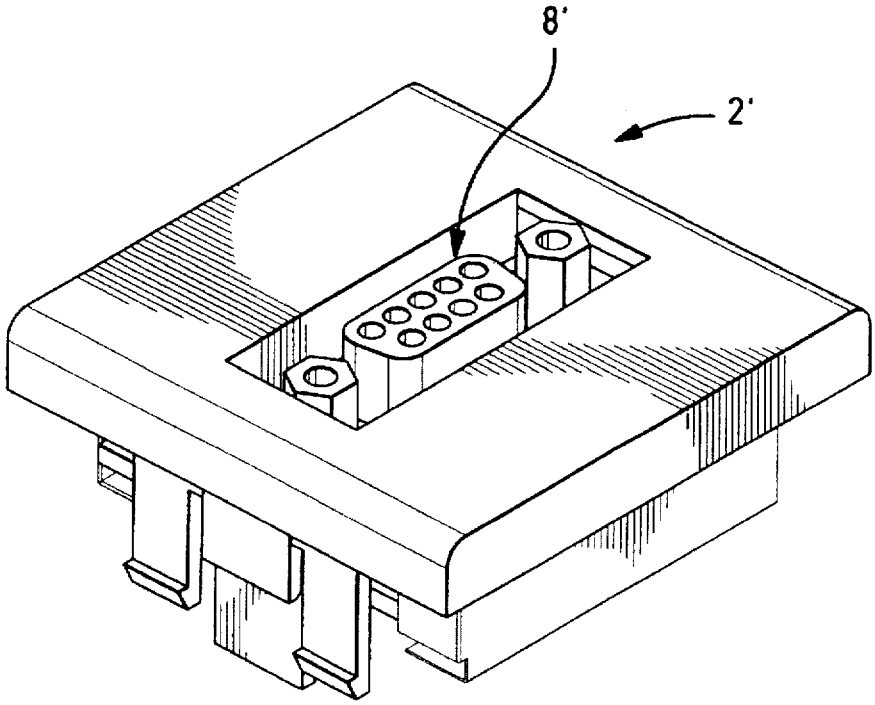
FIGS. 6*a* and 6*b* are isometric views of another embodiment according to this invention with another connector module.
Figure 6B:
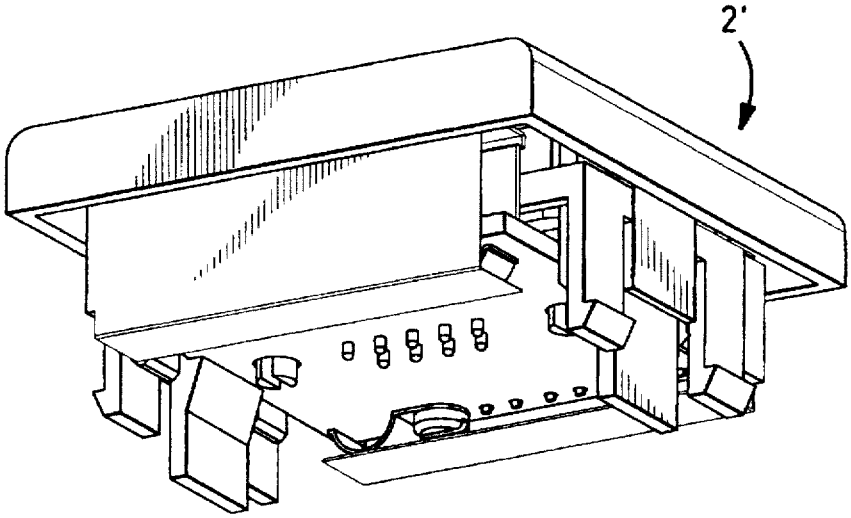
Figure 7A:
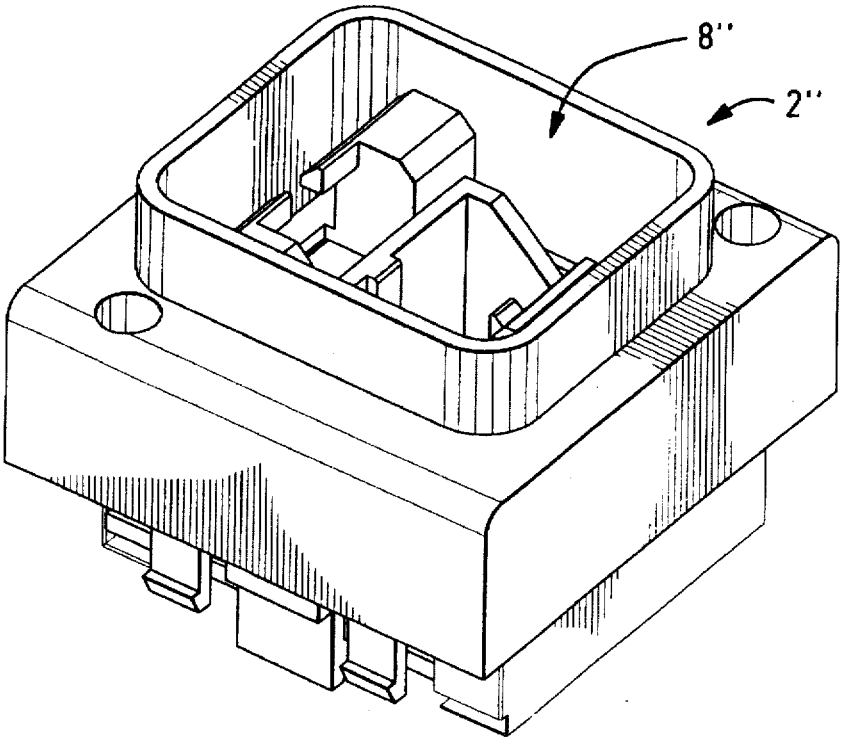
FIGS. 7*a* and 7*b* are isometric views of yet another embodiment with yet another connector module.
Figure 7B:
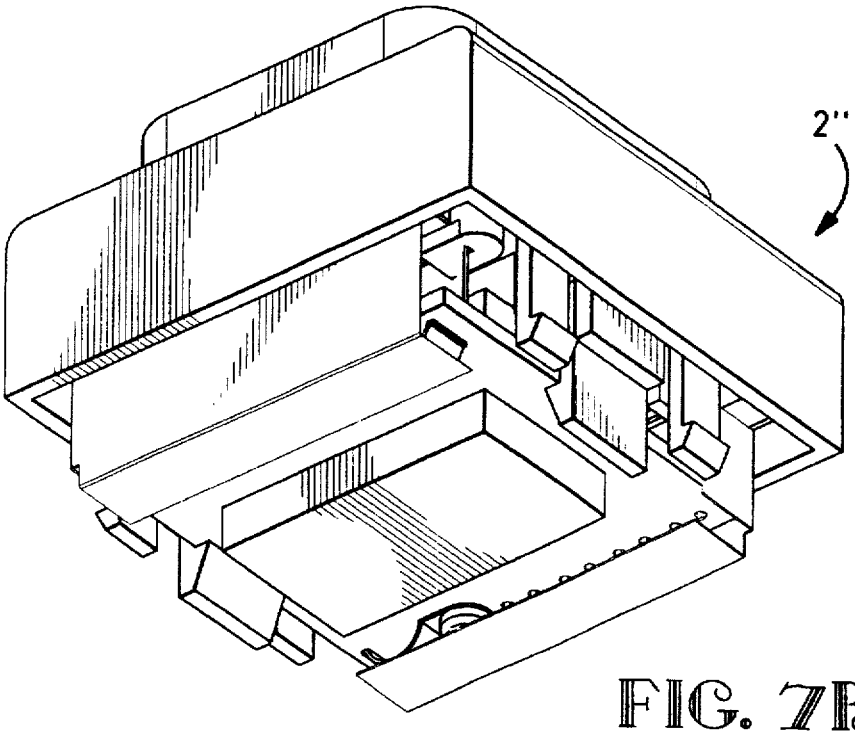

Referring to FIGS. 1 and 5, the face-plate 4 comprises an outer wall 74 having a cutout 75 adapted to receive the outlet connector 8 therethrough. Side walls 76 extend from edges of the outer wall 74 to form an enclosure therewith for covering the cable connector 10 and PCB 12. The connection assembly module 6 is first mounted to a structure prior to mounting of the face-plate 4. The face-plate 4 has locking extensions 78 and 80 extending therefrom that are insertable against the mounting members 44, and 42 respectively. The locking extensions 78 are received within the recesses 46 contiguous the resilient latch 44 thereby providing a secondary locking mechanism that prevents biasing the of the latches 44. The latter securely locks the connection assembly modules 6 to the corresponding structure. In a similar manner, the extension 80 further enhances the security of the assembly of the cable connector 10 to the PCB 12 via the mounting members 42 which act as resilient latches that hook over the edge of the PCB. The extensions 78 also comprise latching protrusions 82 that latch over an end 84 of the latching members 44 for holding the face-plate 4 to the connection assembly module 6. The face-plate 4 can however by rapidly pulled off the connection assembly module if required.

The front wall 74 of the face-plate 4 can be adapted to receive the different outlet connectors 8',8" as shown in FIGS. *6a*, *6b*, *7a*, *7b*.

Advantageously therefore, a compact, low profile communications outlet is provided that is nevertheless cost-effective and enables easy and rapid exchange of connection modules, and provides a secure mounting to a structure.

I claim:

1. A communications outlet comprising a face-plate having a front wall and a connection assembly module mountable to a structure, and for connection to a communications cable having conductors, the connection assembly module comprising a printed circuit board (PCB) and an outlet connector mounted thereon and accessible through a cutout in the face-plate front wall for connection to an external complementary connector, wherein the assembly module further comprises a frame securely mountable on the PCB, and a cable connector with one or more insulative housings and insulation displacing contact (IDC) terminals received in each housing for connection to conductors of the cable, the frame further comprising latching members for rapid tool-less mounting of the module to the structure, whereby the frame and one or more insulative housings extend substantially alongside one or more outer edges of the PCB to form an open central area within which the outlet connector is received.

2. The communications outlet of claim 1 wherein the frame latching members and insulative housings are integrally moulded as one part.

3. The outlet of claim 1 wherein a pair of the insulative housings are integrally moulded as one part.

4. The outlet of claim 1 wherein there are a pair of the insulative housings extending alongside first opposed edges of the PCB.

5. The outlet of claim 4 wherein the latching members are mounted adjacent transverse second opposed edge of the PCB that extend between the first opposed edges.

6. The outlet of claim 1 wherein the face-plate comprises locking extensions that are mountable contiguous the latching members of the module, to lock the latching members and thereby ensure secure retention of the module to the structure.

7. The outlet of claim 6 wherein the locking extensions comprise latching means that interengage with the frame for holding the face-plate thereto.

8. The outlet of claim 1 wherein cable fixing clamps are provided against a lower surface of the PCB, the clamps also serving to contact conductive shielding of the cable in the event that the cable is provided with shielding.

9. The outlet of claim 1 wherein a shield member is provided, the shield member having side, top and bottom walls forming an enclosure that is ounted alongside an edge of the PCB and covering the cable connector housing and terminals on one side of the PCB, further covering the exposed wires of the cable on the other side of the PCB.

10. The outlet of claim 9 wherein the shield resiliently abuts the cable clamp for grounding connection thereof.

11. The outlet of claim 8 wherein there are two cable clamps positioned at diametrically opposed corners of the PCB.

12. The cable clamp of claim 1 wherein the cable connector comprises stuffer caps having wire receiving holes positioned over the IDC terminals, the caps for stuffing wires received in the holes into slots of the IDC terminals for electrical connection therewith.

* * * * *